United States Patent [19]

Erbse et al.

[11] Patent Number: 4,902,446

[45] Date of Patent: Feb. 20, 1990

[54] METHOD FOR REDUCING THE VOLUME OF RADIOACTIVELY LOADED LIQUIDS, AND FINNED BODY FOR USE IN THE PROCESS

[75] Inventors: Dietmar Erbse, Rodenbach; Lydia Fuchs, Aschaffenburg; Dietmar Bege, Erlangen; Horst Queiser, Bruchköbel; Siegfried Meininger, Altenstadt, all of Fed. Rep. of Germany

[73] Assignee: Siemens Aktiengesellschaft, Munich, Fed. Rep. of Germany

[21] Appl. No.: 768,506

[22] Filed: Aug. 22, 1985

[30] Foreign Application Priority Data

Aug. 31, 1984 [DE] Fed. Rep. of Germany ..... 3432103

[51] Int. Cl.[4] ..... G21F 9/08

[52] U.S. Cl. ..... 252/632; 252/633; 159/29; 159/31; 159/47.3; 159/DIG. 12; 219/284; 219/285; 219/288

[58] Field of Search ..... 159/23, 29, 31, 47.1, 159/47.3, DIG. 12; 252/631, 632, 633, 628, 626; 219/284, 285; 34/15, 39, 40, 92; 419/7

[56] References Cited

U.S. PATENT DOCUMENTS

| | | | |
|---|---|---|---|
| 3,153,566 | 10/1964 | Spector | 252/632 |
| 3,912,577 | 10/1975 | Akune | 423/207 |
| 4,008,171 | 2/1977 | Tiepel et al. | 252/632 |
| 4,119,560 | 10/1978 | Sheeline | 159/47.3 |
| 4,246,233 | 1/1981 | Sheeline | 422/159 |
| 4,305,780 | 12/1981 | Black | 252/632 |
| 4,314,877 | 2/1982 | Quieser et al. | 159/47.3 |
| 4,369,351 | 1/1983 | Massey et al. | 219/284 |
| 4,444,680 | 4/1984 | Kitzes et al. | 159/DIG. 12 |
| 4,559,170 | 12/1985 | Gay et al. | 252/626 |
| 4,563,335 | 1/1986 | Akiuama et al. | 422/186 |
| 4,566,204 | 1/1986 | Friesner et al. | 252/632 |

FOREIGN PATENT DOCUMENTS

| | | | |
|---|---|---|---|
| 1564276 | 4/1970 | Fed. Rep. of Germany . | |
| 1614071 | 8/1972 | Fed. Rep. of Germany . | |
| 1639299 | 11/1972 | Fed. Rep. of Germany . | |
| 0021081 | 2/1978 | Japan | 159/47.3 |
| 0043200 | 4/1978 | Japan | 252/632 |

*Primary Examiner*—Howard J. Locker

*Attorney, Agent, or Firm*—Herbert L. Lerner; Laurence A. Greenberg

[57] ABSTRACT

Reducing the volume of radioactively loaded liquids, particularly evaporator concentrates, by heating in a storage container up to solidification, wherein liquids are replenished for filling up the storage container. Heating takes place discontinuously in heating periods separated from each other in time. The heat is introduced directly into the container contents. Vapors produced are drawn off intermittently.

16 Claims, 5 Drawing Sheets

METHOD FOR REDUCING THE VOLUME OF RADIOACTIVELY LOADED LIQUIDS, AND FINNED BODY FOR USE IN THE PROCESS

BACKGROUND OF THE INVENTION

1. Field of the Invention

The invention relates to a method for reducing the volume of radioactively loaded liquids, particularly of evaporator concentrates, by heating the liquids in a storage container up to a state of solidification, and replenishing the storage container with liquids. It further relates to a finned body for use with these methods.

2. Description of the Prior Art

Methods of the kind mentioned above serve for conditioning wastes from the coolant purification of nuclear power stations This involves particularly aqueous salt solutions with a salt content of 10 to 30%. The methods, called "in-barrel drying" for short, for instance, according to German Patent Nos. 15 64 276, 16 14 071 and 16 39 299 are carried out with a heating system arranged above the liquid level, so that the heat leading to the evaporation must penetrate into the liquid from its top side. This results in rather large power consumption and a long treatment time.

SUMMARY OF THE INVENTION

It is therefore an object of the invention to provide a method of reducing the volume of radioactive-containing liquids in a storage container with improved heating of the liquid and with low power consumption, to effect a uniform drying of the entire container contents.

With the foregoing and other objects in view, there is provided in accordance with the invention a method for reducing the volume of radioactively loaded liquids, particularly evaporator concentrates, which comprises heating radioactively loaded liquids in a storage container discontinuously in heating periods separated from each in time by introducing the heat directly into the container contents, intermittently drawing off generated vapors, replenishing the storage container with radioactively loaded liquids, and continuing said heating, said vapor withdrawal and said replenishing to substantially fill the storage container with solid residue remaining after removal of the vapors from the radioactively loaded liquids.

Other features which are considered as characteristic for the invention are set forth in the appended claims.

Although the invention is illustrated and described herein as embodied in a method for reducing the volume of radioactively loaded liquids, and finned body for use in the process, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DESCRIPTION OF THE PREFERRED EMBODIMENTS

Figure 1:
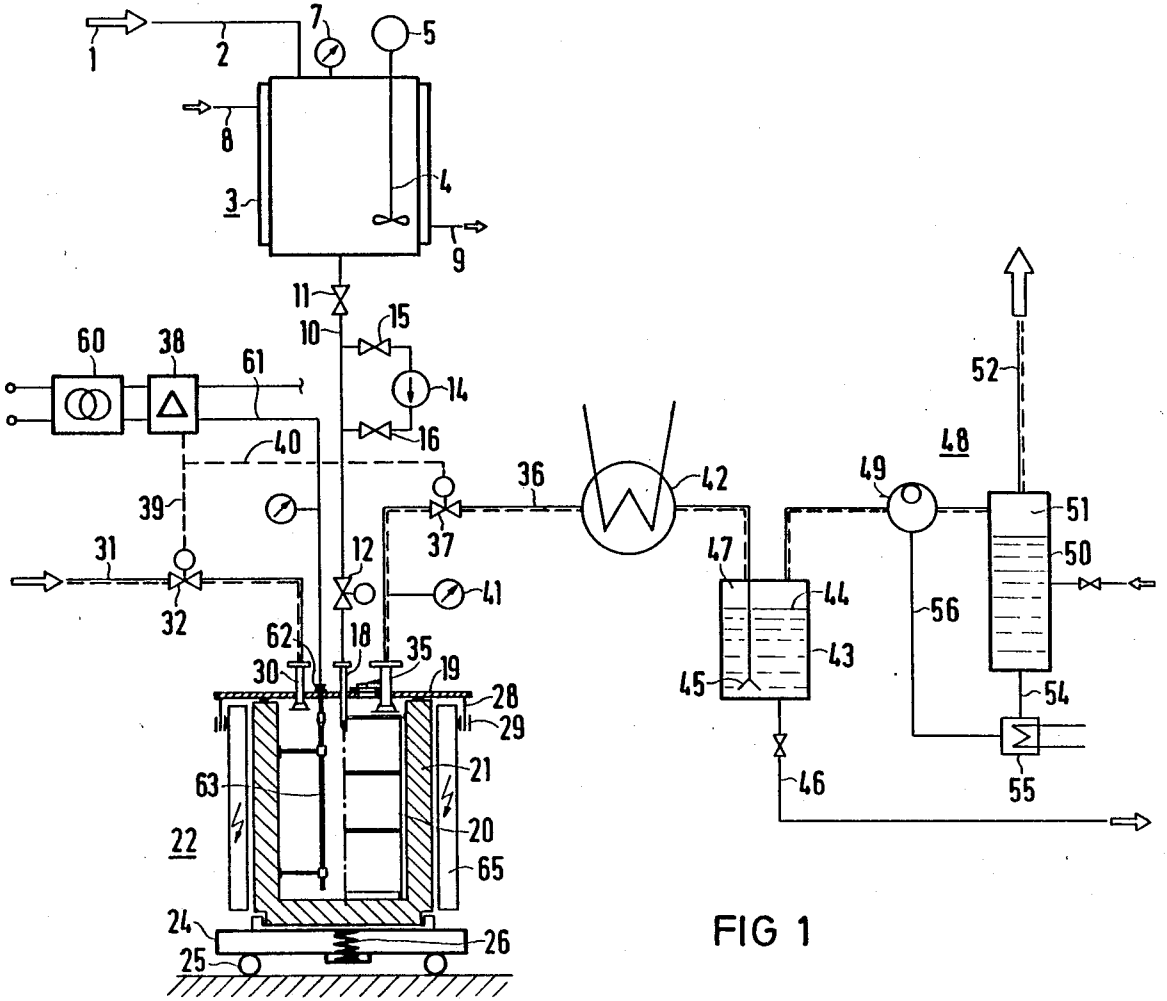
FIG. 1 shows a schematically simplified presentation for a system, in which the method according to the invention is used.

In order to reduce the volume of radioactively loaded liquids, the liquids can be heated in a storage container up to solidification. This is done discontinuously in heating periods which are separated from each other in time, the heat being introduced directly into the container content. The vapors produced are preferably drawn off intermittently. Between the heating periods, venting may also be provided. The invention is intended particularly for the treatment of evaporator concentrates in the coolant purification in nuclear power stations.

According to the invention, the heating takes place discontinuously in heating periods separated from each other in time and the heat is introduced directly into the container content, and vapors produced are drawn off intermittently. In this manner, a faster and more cost-efficient solidification of the container content which consists primarily of salts can be achieved. In contrast to previous continuous heating and vapor exhaust, the container content is subjected to a homogenization of the container content in the pauses which are, for instance, 20 minutes between heating periods of about 10 minutes, which promotes the further drying to a surprisingly high degree. The distillation capacity is substantially increased over the uniform, otherwise customary heating. For this reason, the drying can be continued to the point that long-time trouble-free storage of the wastes is possible without further treatment because a practically homogeneous, largely crystalline salt block is produced.

The vapors can advantageously be drawn off at time intervals in a vacuum if venting takes place in the pauses between times of vapor withdrawal. It improves the transfer of moisture from the container content into a condenser or the like. At the same time, inhibition of uniform heating by local dry zones is prevented thereby.

The heating periods can be controlled preferably as a function of the electric conductivity of the container content. The conductivity can readily be determined by known methods and rugged means and is an easily correlatable measure for the moisture of the container content.

The heating is performed particularly by the direct passage of current in the container content by means of electrodes protruding into the same. While such heating systems are known per se for continuous operation, they produce a special effect in conjunction with the invention because the control of the energy supply via the electrodes is influenced by the drying process itself. The drier the waste, the less current can flow because of the lack of moisture which affects the conductivity. Accordingly, the heating power is less and switching off the energy supply of heat takes place with a pause with venting between two heating periods. The venting causes an equalization of the moisture and thereby, an improvement of the conductivity is obtained which is desirable for the next heating period. A metallic wall of the storage container can be used as one electrode. In the case of storage containers made of nonconductive material, for instance, of concrete, the metallic wall can be provided in the form of a lining.

As an alternative, the heating can also be carried out via a finned body which remains in the container content. Also thereby, direct and uniform heating of the container content can be carried out. This is preferably achieved by providing a vertical recess in the finned body and equipping it with a heating element which is retained in the recess and not removed until after the container content is heated for the last time. The heating element can be surrounded here by a heat transfer medium which is filled into the space between the heating element and the recess. The design of the heating element itself depends on the energy carrier used. This can be an electric heating cartridge with resistance heating, but may also be a steam heating element, in which, in the simplest case, the heating steam flows through an annular space, via which the heat is transferred to the finned body.

A finned body which is particularly well suited for use with the method according to the invention is in the form of a pipe closed off at one end, with attached fins pointing away from the pipe axis. The fins have projections for centering the pipe in a container. The projections are advantageously located at both ends of the pipe in order to ensure uniform centering when inserted into the container. Especially good results can be obtained if the projections at adjacent fins are spaced at most 100mm from each other because then, the container content is heated uniformly and completely by the heat flow through the fins.

Several embodiment examples will be described in the following, referring to the attached drawings.

The radioactively loaded liquids treated by the invention involve primarily so-called evaporator concentrates which come from the coolant purifier of a water-cooled nuclear reactor. The evaporation concentrates are salt solutions with a content between 5 and 50% of, particularly, boron salts if a pressurized-water reactor s involved. As shown by the arrow 1, in FIG. 1, the wastes are fed through line 2 to a concentrate container 3. The container 3 is equipped with a stirrer 4 which is operated by a motor 5. A probe, the reading of which is shown at 7, is provided for monitoring the liquid level. The container 3 can be heated, for instance, by a steam line 8 with the outlet 9.

The radioactively loaded liquid to be solidified can be tapped from the container 3 via a line 10, for instance, by opening a shut-off valve 11 or a remote-control valve 12. However, a dosing pump 14 which is arranged between two shut-off valves 15 and 16 may be used.

The line 10 leads to an inlet stub 18 in a cover plate 19 which is tightly fastened on a storage container 20. The storage container 20 is a metallic standard barrel made of metal with a volume of 200 liters which is inserted into a shielding container 21. The shielding container 21 is part of a concentration station 22. Part of the latter is a transport carriage 24 with wheels 25. Carriage 24 has a spring 26 as a pressing-on device, by means of which the shielding container 21 is pressed from below against the plate 19, forming a seal. Guide pins 28 which are engaged by sleeves 29 retain plate 19 in the correct lateral position.

The cover plate 19 carries a further stub 30, to which an air supply line 31 with a motor-operated valve 32 is connected. An air exhaust line 36 is connected to a further pipe stub 35 which has a larger diameter. The exhaust air line contains a remotely controlled valve 37. The latter, like the valve 32, is coupled to a control 38 as indicated by the functional lines 39 and 40. To the exhaust air line 36 is further connected a pressure measuring device 41 such as a pressure gauge.

The exhaust air line 36 leads into a condenser 42. The latter is followed by a washing tank 43, the liquid level of which is indicated at 44. Below the liquid level, there is the discharge nozzle 45 of the discharge line 36. The water volume can be given off to the waste water processing plant via a line 46.

The gas space 47 of the washing tank is connected to a vacuum system 48. Part of the latter is a water ring pump 49, the output line of which leads to a washing tank 50. The gas space 51 of the washing tank 50 is in communication with an exhaust air line 52. A water line 54 connected at the underside of the washing tank 50, leads to the water line 56 of the water ring pump 49 via a cooler 55. Additional water or make-up water may be fed to washing tank 50 as indicated by an arrow directed into the tank.

The control 38 is connected to a transformer 60, via which a low-voltage line 61 leads to a feed-through 62 in the cover plate 19. An electrode rod 63 is provided at the inner end of the feed-through 62. The electrode rod serves for electric heating of the tank content by resistance heating in the electrolytically conducting tank content. The tank content can be heated additionally by means of an external heater 65 mounted at the shielding container 21.

The heating is controlled by the controller 38 to obtain intermittent operation. Heating periods averaging 10 to 30 minutes in duration (depending on the size of the volume to be heated) alternate with pauses of 10 to 60 minutes in duration (depending on the liquid inventory and the pressure). In the pauses, the controller 38 shuts off the vacuum of 0.1 bar in the exhaust air line 36 by closing the valve 37, and the containers 20 and 21, respectively, are vented with atmospheric air at normal pressure by opening the valve 32 in the feed-air line 31. This provides homogenization of the tank content and avoidance of local dry zones, for instance, in the vicinity of the electrode which have an adverse effect on the uniform heating and drying of the container content.

Figure 2:
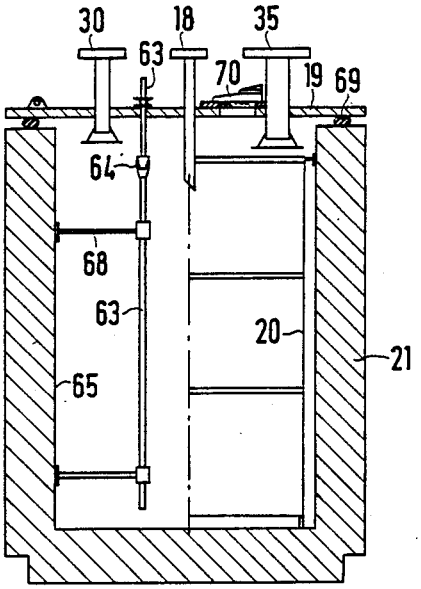
FIG. 2 shows, magnified, a container which is filled with wastes according to the method of the invention.

FIG. 2 shows that the electrode 63 is connected via a plug contact 64 and is fastened by insulated holders 68. The holders 68 are mounted on the left hand side of FIG. 2 to the wall 65 of the shielding container 21 which consists of concrete or cast iron. The holders 68 may also be attached to the cover plate 19 if separate inner containers are to be charged by the concentrating station 22, as is indicated by the standard barrel 20 on the right-hand side of FIG. 2.

A soft seal 69 is arranged between the shielding container 21 and the cover plate 19. A viewing glass 70 is provided in the cover plate 19 to permit the concentration process to be visually monitored.

Figure 3:
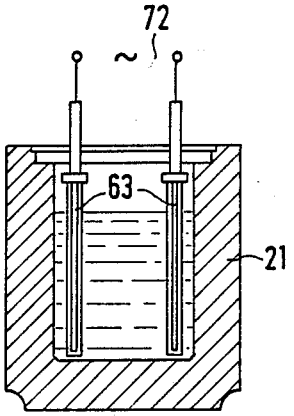
FIGS. 3, 4 and 5 are modifications of the container according to FIG. 2.

In the embodiment shown in FIG. 3, the shielding container 21 is heated by "lost" electrodes 63 which are connected in pairs to an a-c voltage source, such as indicated at 72. At least two electrodes and maximally six electrodes 63 are distributed over the container cross section as uniformly as possible.

Figure 4:
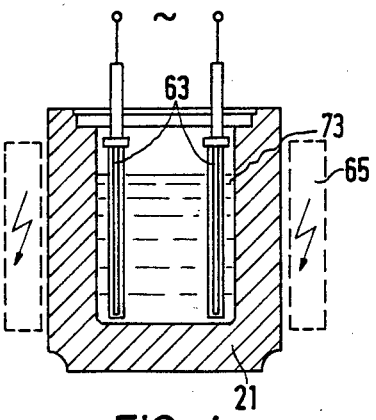
Figure 5:
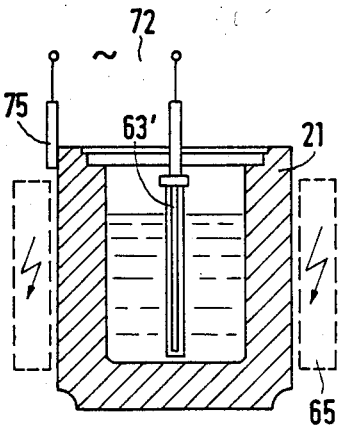

In the embodiment example according to FIG. 4, an external electric heater 65 is provided in addition to the heating with "lost" electrodes 63, so as to also obtain a high temperature at the inner rim 73 of the container 21.

In the embodiment example according to FIG: 5, the shielding container 21 is made of metal. At least, it has a conducting lining. For this reason, the a-c voltage source 72 is connected with the terminal 75 to the conducting vessel 21 as the one electrode. The other electrode is designed as a central electrode 63'. An external heater is indicated at 65.

Figure 6:
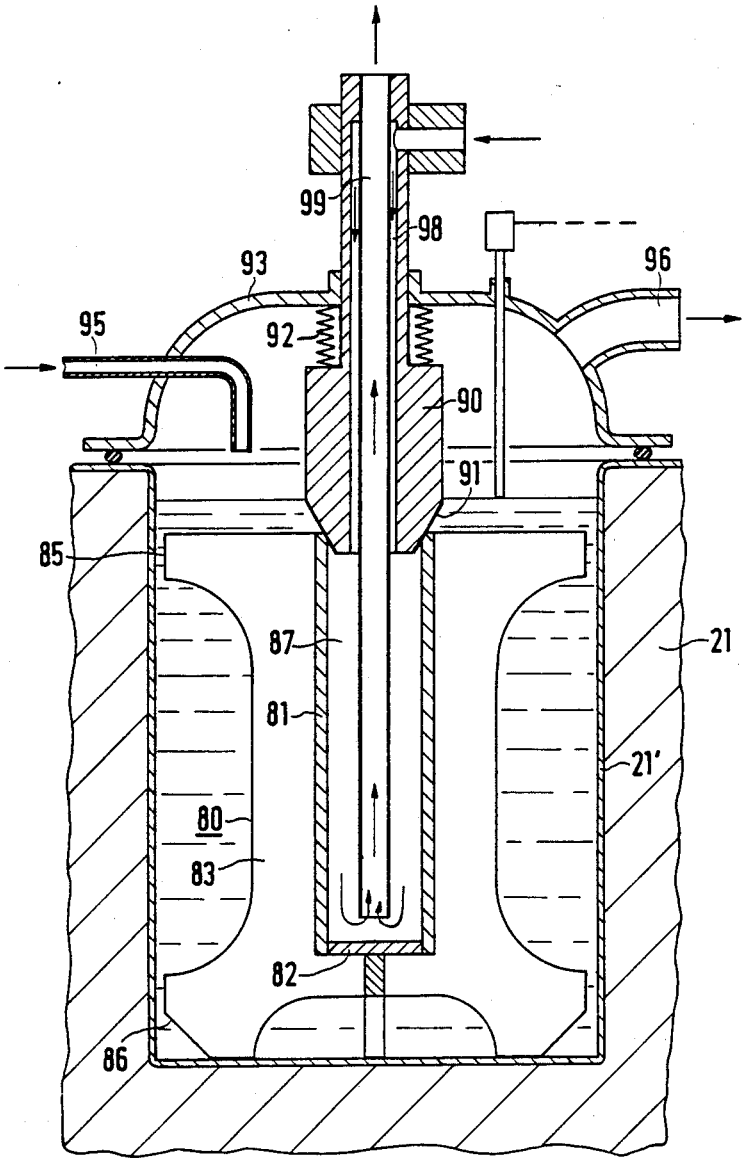
FIG. 6 is another embodiment in which a finned body serves to improve the heat transfer.

In the embodiment example according to FIG. 6, the shielding container 21 with its metal lining 21' is provided with a "lost" heating insert in the form of a finned body 80. The finned body comprises a central pipe 81, the underside of which is closed at 82. On the central pipe 81 are mounted four sheet metal pins 83 with a profile evident from the figure. Upper projections 85 and lower projections 86 are seen, by which the finned body 80 is centered in the container 21.

The interior 87 of the pipe 81 contains a heating device. The latter is pressed onto the pipe 81 by a plug 90 with a conical underside 91. The upper side of the plug 90 is sealed via metal bellows 92 against a cover cap 93 by which the connections at the container 21 are made instead of the cover plate 19. A concentrate line 95 bent in the shape of a hook for feeding in concentrate to be thickened may be seen. On the opposite side is provided a pipe stub 96 for connecting the exhaust air line 36, by means of which moisture is drawn off through stub 96. A heating medium, for instance, heating steam, thermo oil or the like, is brought into the pipe 81 through the plug 90 and lead lines 98 and 99. The heat from the pipe 81 is transported via the fins 83 uniformly into the material to be thickened in the container 21.

Figure 7:
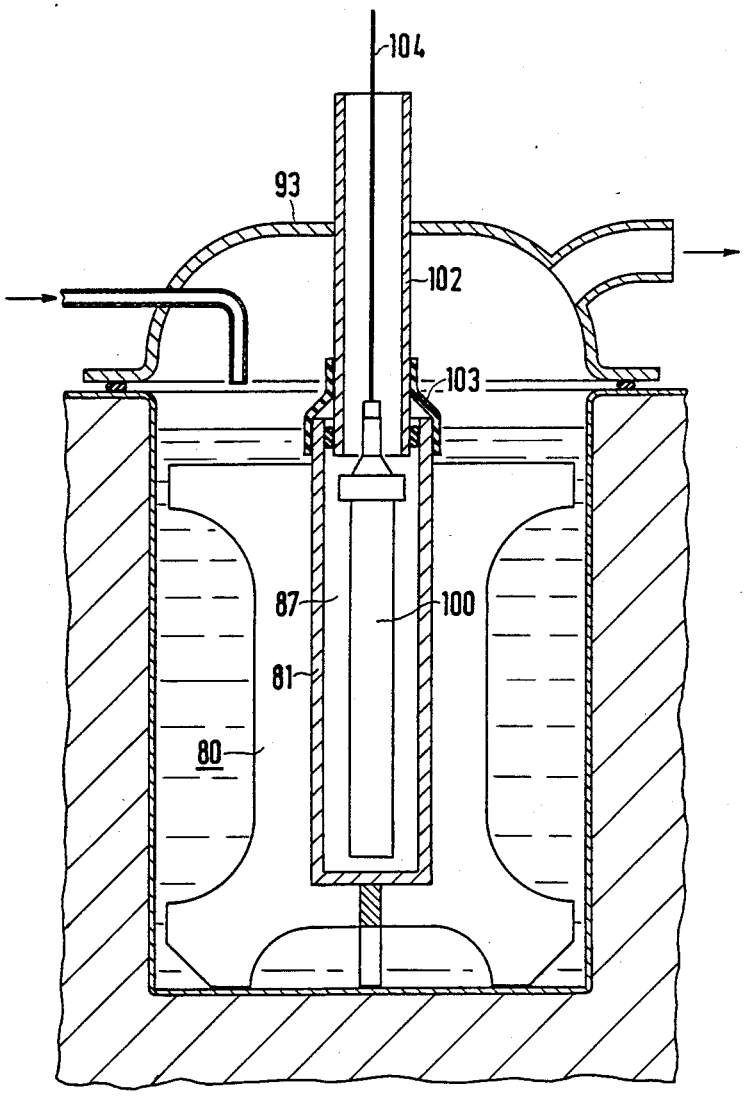
FIG. 7 shows the connection of the finned body in another manner.

In the embodiment example according to FIG. 7, the pipe 81 contains in its interior 87 a heating cartridge 100, preferably in the form of an infrared radiator or the like.

Instead of the plug 91, a pipe 102 is brought through the cap 93. The pipe 102 is sealed at the pipe 81 by a rubber stocking 103. The latter is a "lost" part while the heating cartridge 100 can be taken from the pipe 81 by a holding cable 104.

Figure 8:
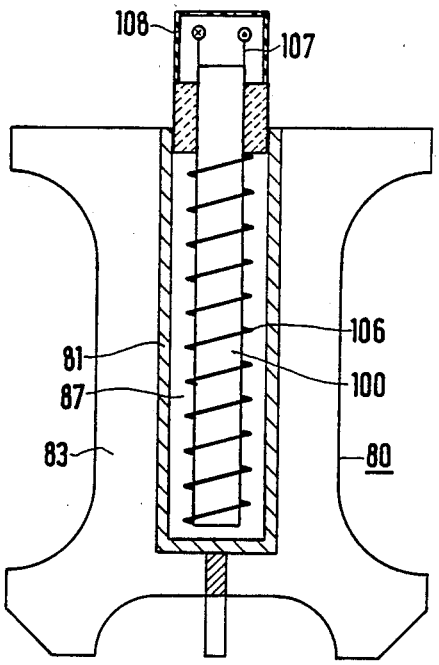
FIG. 8 shows another modified embodiment of the finned body.

In the embodiment example according to FIG. 8, the heating cartridge 100 is designed as a resistance heater with helically arranged heating wires 106. The heating wires are connected via plug-in contacts 107 of a watertight plug 108 to a voltage source.

The foregoing is a description corresponding, in substance, to German application P 34 32 103.9, dated Aug. 31, 1984, international priority of which is being claimed for the instant application and which is hereby made part of this application. Any material discrepancies between the foregoing specification and the specification of the aforementioned corresponding German application are to be resolved in favor of the latter.

There is claimed:

1. An intermittent method of operation for reducing the volume of radioactively loaded liquids, particularly evaporator concentrates, to a solid block of residue which substantially fills a storage container, which comprises (a) heating radioactively loaded liquids in a storage container discontinuously in heating periods separated from each other in time by introducing the heat directly into the container contents, (b) intermittently drawing off generated vapors, (c) venting the storage container in between such times of vapor withdrawal, (d) replenishing the storage container with radioactively loaded liquids, and (e) continuing said heating, said vapor withdrawal, said venting and said replenishing to substantially fill the storage container with a solid block of residue remaining after removal of the vapors from the radioactively loaded liquids.

2. Method according to claim 1, wherein the vapors are drawn off at time intervals in a vacuum.

3. Method according to claim 1, wherein the heating periods are controlled as a function of the electric conductivity of the container content.

4. Method according to claim 1, wherein the heating is accomplished by the direct flow of electric current in the container content by means of electrodes protruding into the latter.

5. Method according to claim 2, wherein the heating is accomplished by the direct flow of electric current in the container content by means of electrodes protruding into the latter.

6. Method according to claim 3, wherein the heating is accomplished by the direct flow of electric current in the container content by means of electrodes protruding into the latter.

7. Method according to claim 4, wherein a metallic wall of the storage container is used as one electrode.

8. Method for reducing the volume of radioactively loaded liquids, particularly evaporator concentrates, which comprises heating radioactively loaded liquids in a storage container discontinuously in heating periods separated from each other in time by introducing the heat directly into the container contents, intermittently drawing off generated vapors, replenishing the storage container with radioactively loaded liquids, and continuing said heating, said vapor withdrawal and said replenishing to substantially fill the storage container with a solid block of residue remaining after removal of the vapors from the radioactively loaded liquids, and wherein the heating is accomplished via a finned body which remains in the container content.

9. Method for reducing the volume of radioactively loaded liquids, particularly evaporator concentrates, which comprises heating radioactively loaded liquids in a storage container discontinuously in heating periods separated from each other in time by introducing the heat directly into the container contents, intermittently drawing off generated vapors, replenishing the storage container with radioactively loaded liquids, and continuing said heating, said vapor withdrawal and said replenishing to substantially fill the storage container with a solid block of residue remaining after removal of the vapors from the radioactively loaded liquids, wherein the vapors are drawn off at time intervals in a vacuum, and venting of the storage container takes place in the pauses in between such times of vapor withdrawal, and wherein the heating is accomplished via a finned body which remains in the container.

10. Method for reducing the volume of radioactively loaded liquids, particularly evaporator concentrates, which comprises heating radioactively loaded liquids in a storage container discontinuously in heating periods separated from each other in time by introducing the heat directly into the container contents, intermittently drawing off generated vapors, replenishing the storage container with radioactively loaded liquids, and continuing said heating, said vapor withdrawal and said replenishing to substantially fill the storage container with a solid block of residue remaining after removal of the vapors from the radioactively loaded liquids, wherein the heating periods are controlled as a function of the electric conductivity of the container content, and wherein the heating is accomplished via a finned body which remains in the container content.

11. Method according to claim 8, wherein a vertical recess is provided in the finned body and is equipped with a heating element, and the heating element is removed after the last heating of the container content.

12. Method according to claim 11, wherein the heating element is surrounded by a heat transfer medium which is filled into the space between the heating element and the recess.

13. Method according to claim 8, wherein the finned body has fins attached to a central pipe closed on one side and point away from the axis of the pipe, and the fins form projections for centering the pipe in the container.

14. Method according to claim 11, wherein the finned body has fins attached to a central pipe closed on one side and point away from the axis of the pipe, and the fins form projections for centering the pipe in the container.

15. Method according to claim 12, wherein the finned body has fins attached to a central pipe closed on one side and point away from the axis of the pipe, and the fins form projections for centering the pipe in the container.

16. Method according to claim 13, wherein the projections are located at both ends of the pipe.

* * * * *